US007849918B2

(12) United States Patent
Ehlinger et al.

(10) Patent No.: US 7,849,918 B2
(45) Date of Patent: Dec. 14, 2010

(54) CENTERING STRUCTURE FOR TUBULAR MEMBER AND METHOD OF MAKING SAME

(75) Inventors: Jeff Ehlinger, Houston, TX (US); Larry Graen, Houston, TX (US)

(73) Assignee: Davis-Lynch, Inc., Pearland, TX (US)

( * ) Notice: Subject to any disclaimer, the term of this patent is extended or adjusted under 35 U.S.C. 154(b) by 144 days.

(21) Appl. No.: 12/166,719

(22) Filed: Jul. 2, 2008

(65) Prior Publication Data

US 2009/0008086 A1 Jan. 8, 2009

Related U.S. Application Data

(60) Provisional application No. 60/958,076, filed on Jul. 2, 2007.

(51) Int. Cl.
*E21B 17/10* (2006.01)

(52) U.S. Cl. ..... 166/241.6

(58) Field of Classification Search ..... 166/241.6, 166/241.7, 196; 175/320, 325.1, 325.5, 325.6; 72/393

See application file for complete search history.

(56) References Cited

U.S. PATENT DOCUMENTS 2,898,136 A * 8/1959 Hall, Sr. et al. ..... 403/6
2,922,478 A * 1/1960 Maly ..... 166/154
3,312,285 A * 4/1967 Solum ..... 166/241.6
4,413,682 A 11/1983 Callihan et al.
4,532,995 A 8/1985 Kaufman
4,696,344 A * 9/1987 Scott et al. ..... 166/182
4,865,127 A * 9/1989 Koster ..... 166/277
5,238,062 A * 8/1993 Reinholdt ..... 166/241.7
5,575,333 A 11/1996 Lirette et al.
5,937,948 A 8/1999 Robbins, III
6,102,118 A * 8/2000 Moore ..... 166/241.7
6,209,638 B1 4/2001 Mikolajczyk
6,637,511 B2 10/2003 Linaker (Continued)

FOREIGN PATENT DOCUMENTS

EP 1223304 A2 7/2002

(Continued)

OTHER PUBLICATIONS http://www.halliburton.com/public/cem/contents/Data_Sheets/web/H/H05051.pdf,Cementing Bow-Spring Centralizers, Halliburton Jun. 2006, USA.

(Continued)

*Primary Examiner*—Kenneth Thompson
(74) *Attorney, Agent, or Firm*—Charles S. Knobloch; Gordon T. Arnold; Arnold & Knobloch, L.L.P.

(57) ABSTRACT

An apparatus and method for manufacture of a unitary centralizer forming Apertures are formed in a blank to create an intermediate blank having bow spring elements within a unitary centralizer and expanding a medial portion of the bow spring elements. An expansion element is inserted into the intermediate blank. An expansive force is applied to the expansion element, thereby expanding the medial portion of the bow spring elements. Mandrels placed against the upper and lower surfaces of the expansion element receive a compressive force for transfer to the expansion element. Set screw holes are placed on the unitary centralizer for attachment.

16 Claims, 8 Drawing Sheets

U.S. PATENT DOCUMENTS

| | | | | |
|---|---|---|---|---|
| 6,679,325 | B2 | 1/2004 | Buytaert | |
| 6,725,939 | B2 | 4/2004 | Richard | |
| 6,772,841 | B2 | 8/2004 | Gano | |
| 6,802,374 | B2 | 10/2004 | Edgar et al. | |
| 6,871,706 | B2 | 3/2005 | Hennessey | |
| 6,877,567 | B2 * | 4/2005 | Hirth | 166/382 |
| 6,997,254 | B2 * | 2/2006 | Jenner | 166/241.6 |
| 7,071,697 | B2 | 7/2006 | Rioufol et al. | |
| 7,140,432 | B2 | 11/2006 | Gremillion | |
| 2003/0000607 | A1 | 1/2003 | Jenner | |
| 2003/0150611 | A1 | 8/2003 | Buytaert | |
| 2003/0230411 | A1 | 12/2003 | Richard | |
| 2006/0124304 | A1 * | 6/2006 | Bloess et al. | 166/285 |
| 2008/0283237 | A1 * | 11/2008 | Buytaert et al. | 166/196 |

FOREIGN PATENT DOCUMENTS

| | | | |
|---|---|---|---|
| EP | 1223305 | A2 | 7/2002 |
| GB | 2403238 | A | 12/2004 |

OTHER PUBLICATIONS http://www.casewellservices.com/nonweldedbow.htm, Casewell Drilling and Cementing Products, Hinged Non Weld Bow Spring Centralizers, 2004-2005.

http://www.halliburton.com/public/cem/contents/Data_Sheets/web/H/H03878.pdf, Intercasing Centralizer Sub A-4, Aug. 2006, USA.

http://www.slb.com/media/services/coiled/tools/inlinecentralizer.pdf, Inline Centralizer, Schlumberger, Coil Tools Catalog, Aug. 5, 2004.

http://www.rayoiltool.co.uk/product-details.php?pid=4, Bi-centered Intercasing, Ray Oil Tool Company.

http://www.slb.com/media/services/coiled/tools/hydrauliccentralizer.pdf, Hydraulic Centralizer, Schlumberger, Mar. 30, 2004.

http://www.steelfabs.com/centralizer_stopcollars.html, Centralizers & Stop Collars/Tubing Centralizer, Steelfabs Offshore Drilling Ltd., Aug. 2006.

Notification of Transmittal of the International Search Report and the Written Opinion of the International Searching Authority, or the Declaration, PCT/US2008/069037, Jul. 2, 2008.

Notification Concerning Transmittal of International Preliminary Report on Patentability and Written Opinion of the International Searching Authority issued Jan. 14, 2010 based on PCT/US2008/069037 filed Jul. 2, 2008, 8 pages.

* cited by examiner

CENTERING STRUCTURE FOR TUBULAR MEMBER AND METHOD OF MAKING SAME

STATEMENT OF RELATED CASES

This application claims the benefit of U.S. Provisional Application No. 60/958,076 filed Jul. 2, 2007.

FIELD OF THE INVENTION

The present invention relates generally to tubular structures used in oil and gas exploration and production, and more particularly to a centralizer structure for maintaining a tubular member in a substantially centralized position within a borehole.

BACKGROUND OF THE INVENTION

Those of ordinary skill in the art will be familiar with a very wide variety of so-called centralizers employed in the processes of oil and gas exploration and production to maintain a segment of tubing ("tubular") in a substantially centralized longitudinal position relative to a surrounding barrier, e.g., a borehole wall, well casing, or a larger tubular). The desire to keep tubulars centralized, and the benefits and advantages of using devices or structures to maintain centralization, are well known to those of ordinary skill in the art.

Among the many different types of centralizers that are presently known, a subset of them can be roughly categorized into a class of so-called "bow spring" centralizers. Bow-spring centralizers are characterized as such due to their having at least one, and more common, a plurality of bow-spring elements adapted to press against an outer barrier or wall and exert a radial inward force on the tubular, such that the tubular tends to be deflected away from the wall. The class of bow-spring centralizers is generally distinguished from another class of centralizers having radially oriented flange-like features adapted to deflect the tubular radially inward toward a central position within a borehole or other tubular enclosure.

Typically, a bow-spring centralizer has a plurality of bow-springs arranged concentrically around a tubular and held at each end by a circumferential collar adapted to be installed around the tubular to be centralized. Each centralizer extends radially outward from the outer surface of the tubular to press against a sidewall thereby exerting a radially-directed inward force upon the tubular. The net effect of the plurality of centralizers is that the tubular is effectively maintained in a relatively central position within the surrounding sidewall or structure.

A known advantage of bow-spring centralizers is that so long as at least one of the end collars is free to slide longitudinally along the tubular it surrounds, the centralizer is capable of being compressed inwardly, so as to be able to progress through passages that are narrower than the diameter of the centralizer in an uncompressed state. Provided that such a centralizer is fashioned from a material such as spring steel or the like that will return to a fully uncompressed form when not compressed by outer forces, the centralizer can adapt to conditions, such as within a borehole, in which the path taken by the centralizer is of varying diameter along its length.

The number of prior art examples of bow-spring centralizers is so large, and the general concept of operation and use of bow-spring centralizers is so well known, that no particular prior art example would necessarily stand as "exemplary" of the entire class of bow-spring centralizers.

Conventional bow-spring centralizers are typically provided with a plurality of bow-springs (e.g., four or more), equally spaced around the circumference of a tubular and held or otherwise secured at each end to a cylindrical collar adapted to fit around the outer circumference of the tubular to be centralized. In many prior art designs, each bow spring is a separate element, and a mechanical means is required to attach each end of each bow-spring to an end collar. Innumerable variations of such bow-spring centralizers have been proposed in the prior art. The bow-springs may be mechanically interlocked with the end collars, as proposed by U.S. Pat. No. 6,871,706 to Hennesey, entitled "Casing Centralizer," or the bow-springs may be affixed to end collars by means welding and/or with 3 connection pins, screws, rivets, or the like. Once again, innumerable examples of this type of bow-spring centralizer exist in the prior art. See, for example, U.S. Pat. No. 5,575,333 to Lirette et al., entitled "Centralizer."

The use of mechanical means for interconnecting a centralizer's bow springs with its end collars has proven to be reasonably effective in the oil and gas industry. However, it has long been realized that it is desirable to provide a centralizer design that has minimal impact on the overall outer diameter of the centralized tubular, in order for the tubular to travel through passageways which may constrict at certain points to a diameter only marginally larger than the tubular itself.

Thus, for example, it is been recognized that any means of connecting a bow-spring to its end collars that tends to project radially outward from the centralized tubular to any appreciable extent is generally undesirable. Any such feature of a centralizer will tend to increase frictional forces on the tubular's travel. This is addressed, for example, in U.S. Pat. No. 6,679,325 to Buytaert, entitled "Minimum Clearance Bow-Spring Centralizer."

Furthermore, many of the means of connecting bow-springs to respective end collars providing for the least radial expanse of the tubular/centralizer combination are susceptible to mechanical failures where bow-springs can become detached from their end collars and hence rendered incapable of functioning as intended. This is true, for example, of designs in which the bow springs are welded at each end to the end collars, as is the case in many prior art implementations.

To avoid the necessity of mechanically fastening bow springs to the end collars, it has been proposed in the prior art to form a centralizer out of a flat sheet of steel, with apertures being formed therein to define end collar regions and bow-spring regions. The flat sheet is then rolled into a substantially cylindrical form, with respective sides of the flat sheet coming together to form a longitudinal seam in the resulting cylindrical centralizer. This is shown, for example, in U.S. Pat. No. 6,997,254 to Jenner, entitled "Method of Making a Centering Device and Centering Device Formed by That Method."

The approach proposed in the Jenner '254 patent may be deemed less than optimal, inasmuch as it merely substitutes the need for mechanical fixation between opposing edges for the need for mechanical fixation of the bow-springs to the end collars. The Jenner '254 patent suggests that the respective edges of the rolled structure can be mechanically coupled by means of hinge pins or interlocking finger portions. In either case, this mechanical coupling may be susceptible to failure, and the presence of protruding features is not avoided. Moreover, the Jenner '254 approach involves the additional fabrication step(s) and associated tooling that would be necessary to roll the initially flat sheet(s) of steel to form a cylindrical centralizer.

SUMMARY OF THE INVENTION

In view of the foregoing, the present invention is directed to a bow-spring centralizer of unitary construction, such that detachment of bow-springs from their respective end collars is of little or no concern. Furthermore, the present invention is directed in another aspect to a method of fabricating a centralizer of unitary construction.

In accordance with one example of the invention, a centralizer is disclosed that is formed from a blank in the form of a section of unitary, cylindrical steel tubing. A plurality of apertures are formed on the side of the tubing, thereby defining top and bottom end collar portions and integral bow-spring portions extending between the collar portions.

In accordance with another example of the invention, a semi-rigid, expandable element is inserted into the unexpanded blank, and a pair of mandrels are brought to bear upon the upper and lower surfaces of the expandable element. Considerable force is exerted on the expandable element by the mandrels, for example, by use of a hydraulic or mechanical press. Radial outward expansion of the expandable element forces the bow-spring portions of the centralizer to deform outwardly.

In accordance with one set of examples of the invention, a centralizer is disclosed for maintaining a tubular member in a substantially centralized position within a borehole, the centralizer including: a substantially seamless material of substantially cylindrical shape having a circumferential wall, an upper end, and a lower end; a plurality of apertures in the circumferential wall having an upper end and a lower end, where the apertures define an upper collar element, a lower collar element of the circumferential wall, and bow spring elements disposed between the upper collar element and lower collar element; and where each bow spring element has a medial portion of the bow spring element that is expandable radially such that the circumference of the centralizer is larger around the medial portions of the bow spring elements than the around the upper collar element and the lower collar element.

In another example, a centralizer is disclosed where the substantially seamless material is substantially homogeneous.

In another example, a centralizer is disclosed where the bow spring elements are elastically deformable to reduce the circumference of the centralizer around the medial portions of the bow spring elements. In a further example, a centralizer is disclosed where the substantially seamless material is substantially homogeneous. In a still further example, a centralizer is disclosed that further includes a plurality of set screw holes extending radially through at least one of the upper collar element and the lower collar element. In a still further example, a centralizer is disclosed where the set screw holes are threaded.

In one set of examples of the invention, a method of fabricating a centralizer is disclosed, for maintaining a tubular member in a substantially centralized position within a borehole, the method including the steps of: forming a plurality of apertures in a substantially seamless material of substantially cylindrical shape having a circumferential wall, an upper end, and a lower end to create an intermediate blank; where the plurality of apertures in the circumferential wall having an upper end and a lower end define an upper collar element, a lower collar element of the circumferential wall, and bow spring elements disposed between the upper collar element and lower collar element; expanding a medial portion of the bow spring elements to cause plastic deformation of the bow spring elements; and where the circumference of the centralizer is larger around the medial portions of the bow spring elements than the around the upper collar element and the lower collar element.

In another example, the substantially seamless material is substantially homogeneous. In a further example the step of expanding further includes the steps of: inserting an expansion element having a substantially cylindrical shape with an upper face, a lower face, and a flexible circumferential wall into the interior of the intermediate blank; and applying a compressive force to at least one of the upper face and the lower face causing the expansion element to expand radially as it is compressed axially. In a still further example, the step of applying a compressive force further includes the steps of: placing an upper mandrel and a lower mandrel in contact with the upper face and lower face of the expansive element, respectively; and applying a compressive force to at least one of the upper face and the lower face through the upper mandrel and the lower mandrel, causing the expansion element to expand radially as it is compressed axially.

In another example, the expansion element being inserted into the interior of the intermediate blank is made of an elastomer which expands radially as it is compressed axially. In a further example, the expansion element includes a plurality of holes extending through the expansion element in a longitudinal direction of the expansion element. In a further example, the step of applying a compressive force further includes the steps of: placing an upper mandrel and a lower mandrel in contact with the upper face and lower face of the expansive element, respectively; and applying a compressive force to at least one of the upper face and the lower face through the upper mandrel and the lower mandrel, causing the expansion element to expand radially as it is compressed axially.

In another example, a method of fabricating a centralizer is described that includes forming a plurality of set screw holes extending radially through at least one of the upper collar element and the lower collar element. In a further example, a method of fabricating a centralizer is described that further includes threading the plurality of set screw holes.

BRIEF DESCRIPTION OF THE DRAWINGS

The foregoing and other features and aspects of the present invention will be best appreciated by reference to a detailed description of the specific examples of the invention, when read in conjunction with the accompanying drawings, wherein.

DETAILED DESCRIPTION OF SPECIFIC EXAMPLES OF THE INVENTION

In the disclosure that follows, in the interest of clarity, not all features of actual implementations are described. It will of course be appreciated that in the development of any such actual implementation, as in any such project, numerous engineering and technical decisions must be made to achieve the specific objectives (e.g., compliance with system and technical constraints), which will vary from one implementation to another. Moreover, attention will necessarily be paid to proper engineering practices for the environment in question. It will be appreciated that such a development effort might be complex and time-consuming, but would nevertheless be a routine undertaking for those of ordinary skill in the relevant fields.

Figure 1:
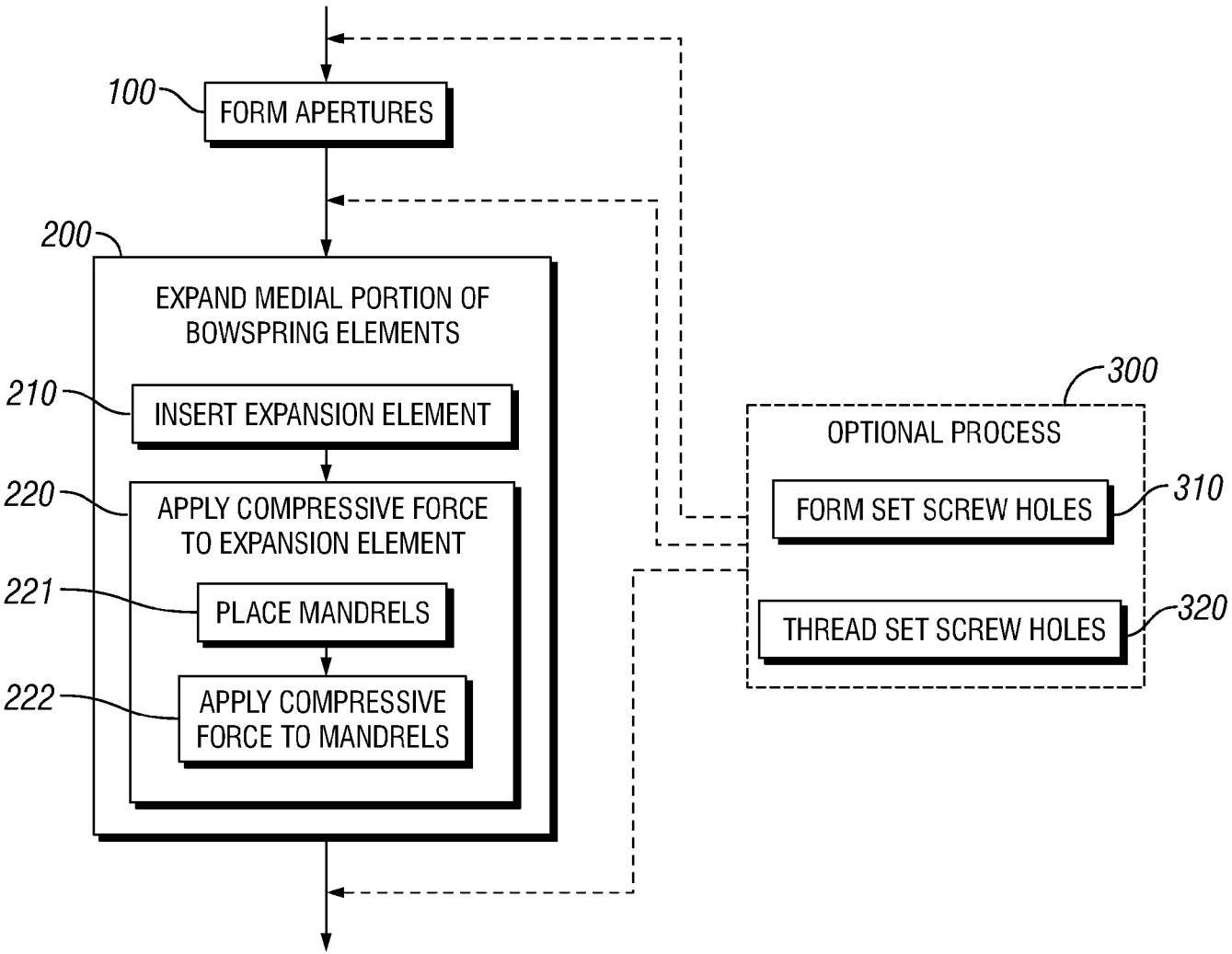
FIG. 1 is a flow diagram for a method of manufacture of a unitary centralizer in accordance with the present invention.

FIG. 1 is a flow diagram for a method of manufacture of a unitary centralizer in accordance with the present invention. The method in this example includes forming apertures in a blank 100 to create an intermediate blank 10A (FIG. 2) having bow spring elements within the unitary centralizer and expanding a medial portion of the bow spring elements 200. The step of expanding a medial portion of the bow spring elements in this example further includes inserting an expansion element into the intermediate blank 210 and applying an expansive force to the expansion element 220. The step of applying a compressive force in this example further includes placing mandrels against the upper and lower surfaces of the expansion element 221 and applying a compressive force to the mandrels 222. An optional process 300 in this example is to form set screw holes 310 and thread those set screw holes 320. In this example this optional process 300 is performed either before or after forming apertures 100 or before or after expanding a medial portion of the bow spring elements 200.

Figure 2:
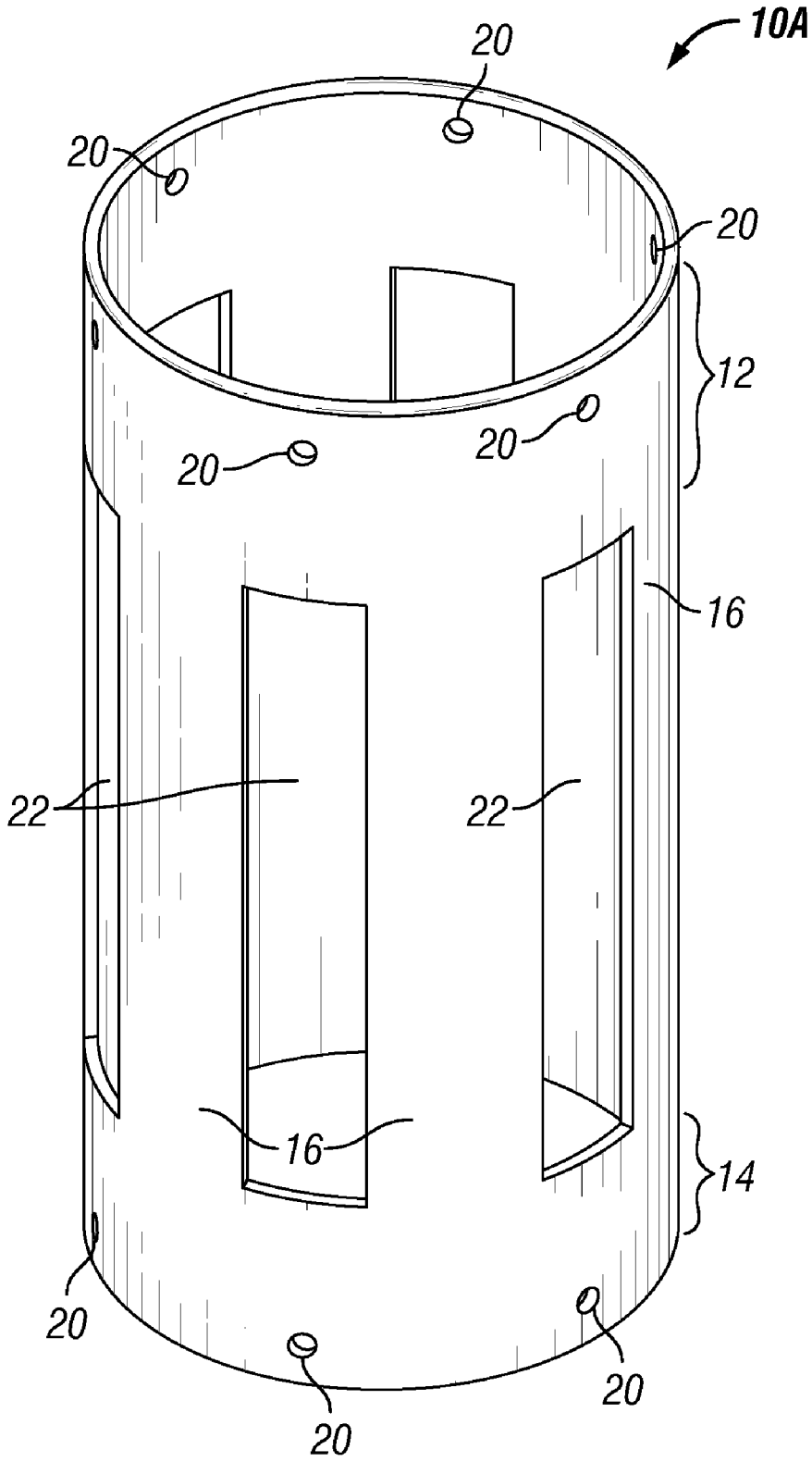
FIG. 2 is a perspective view of a blank from which a bow-spring centralizer in accordance with the present invention is formed, with apertures formed in the sides thereof to define a plurality of bow-spring elements extending between upper and lower collar portions thereof.

FIG. 2 is a perspective view of an intermediate blank 10A from which a bow-spring centralizer in accordance with the present invention is formed. Apertures 22 formed in the sides thereof to define a plurality of bow-spring elements 16 extending between top collar 12 and bottom collar 14 portions thereof. In one example, threaded set screw holes 20 are circumferentially arranged around the top collar 12 and bottom collar 14 portions.

Figure 3:
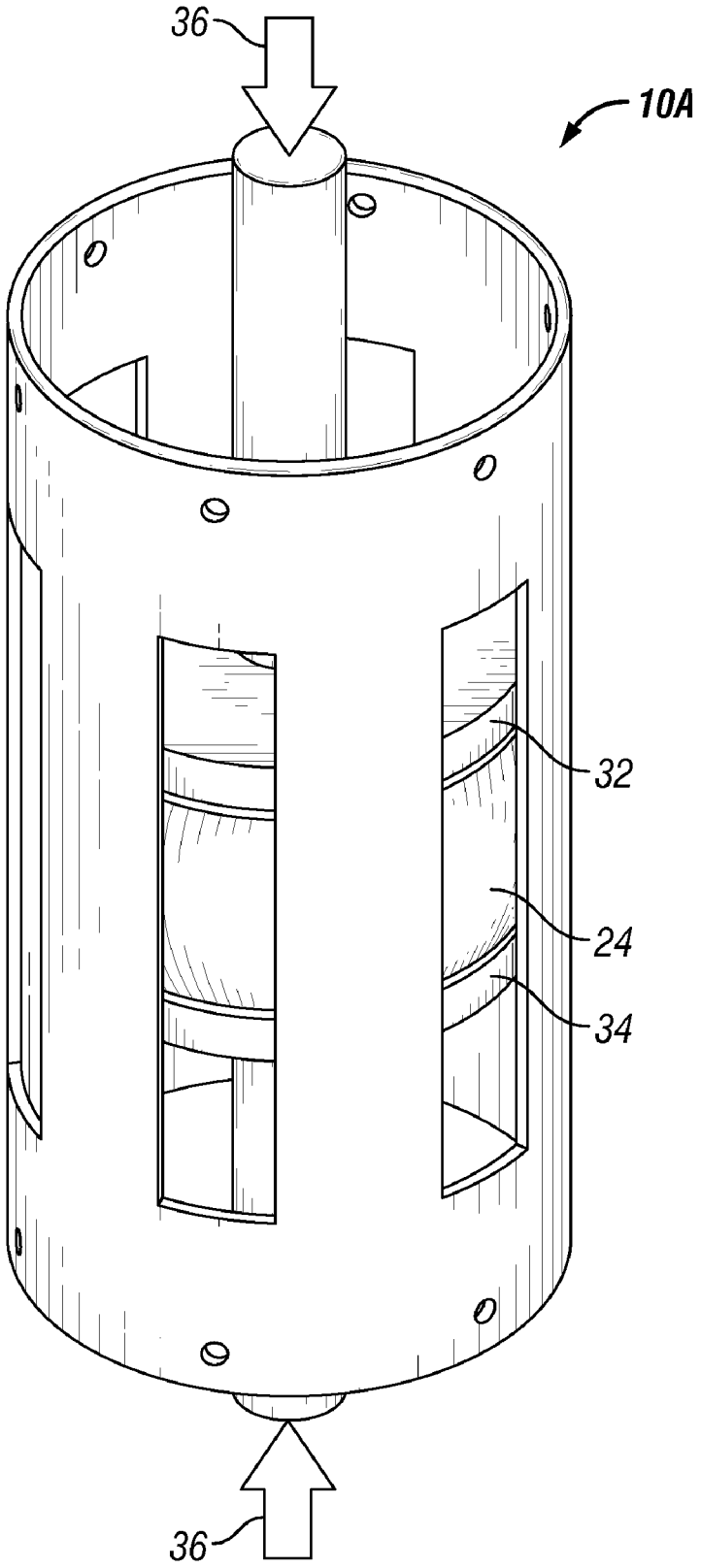
FIG. 3 is a perspective view of the blank from FIG. 2, showing an expansion element disposed therein between upper and lower mandrels.

FIG. 3 is a perspective view of blank 10A from FIG. 2, showing an expansion element 24 disposed therein between an upper mandrel 32 and a lower mandrel 34. Arrows 36 indicate application of compression force to mandrels 32 and 34.

Figure 4:
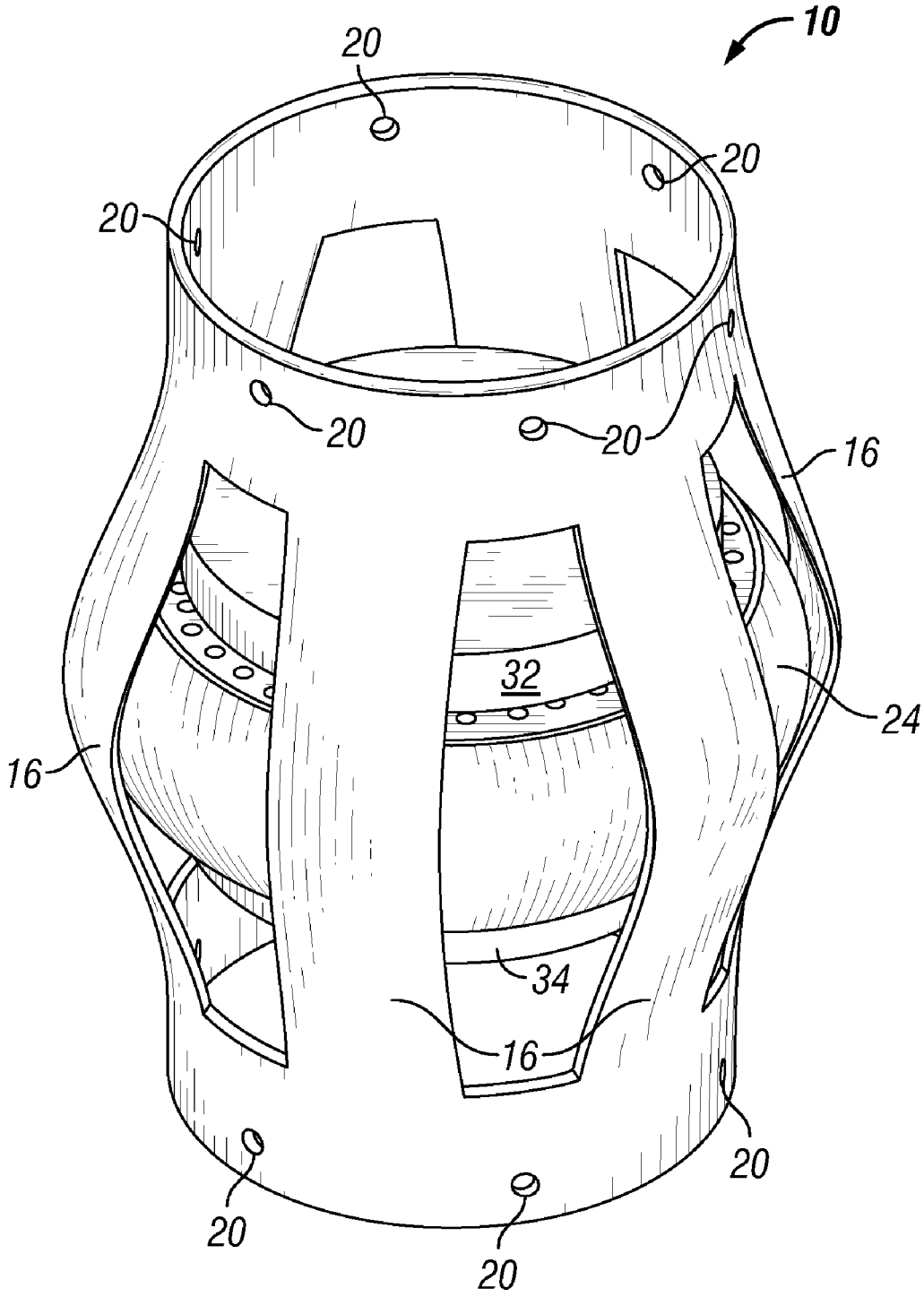
FIG. 4 is a perspective view of the centralizer in accordance with the present invention following application of force on the mandrels causing radial outward expansion of the bow spring elements (portions of the mandrels are not shown in FIG. 4 for clarity)

FIG. 4 is a perspective view of a centralizer 10 in accordance with one example of the present invention following application of force on mandrels 32 and 34, causing radial outward deformation of bow spring elements 16. Portions of mandrels 32 and 34 are not shown in FIG. 4 for clarity.

Figure 5:
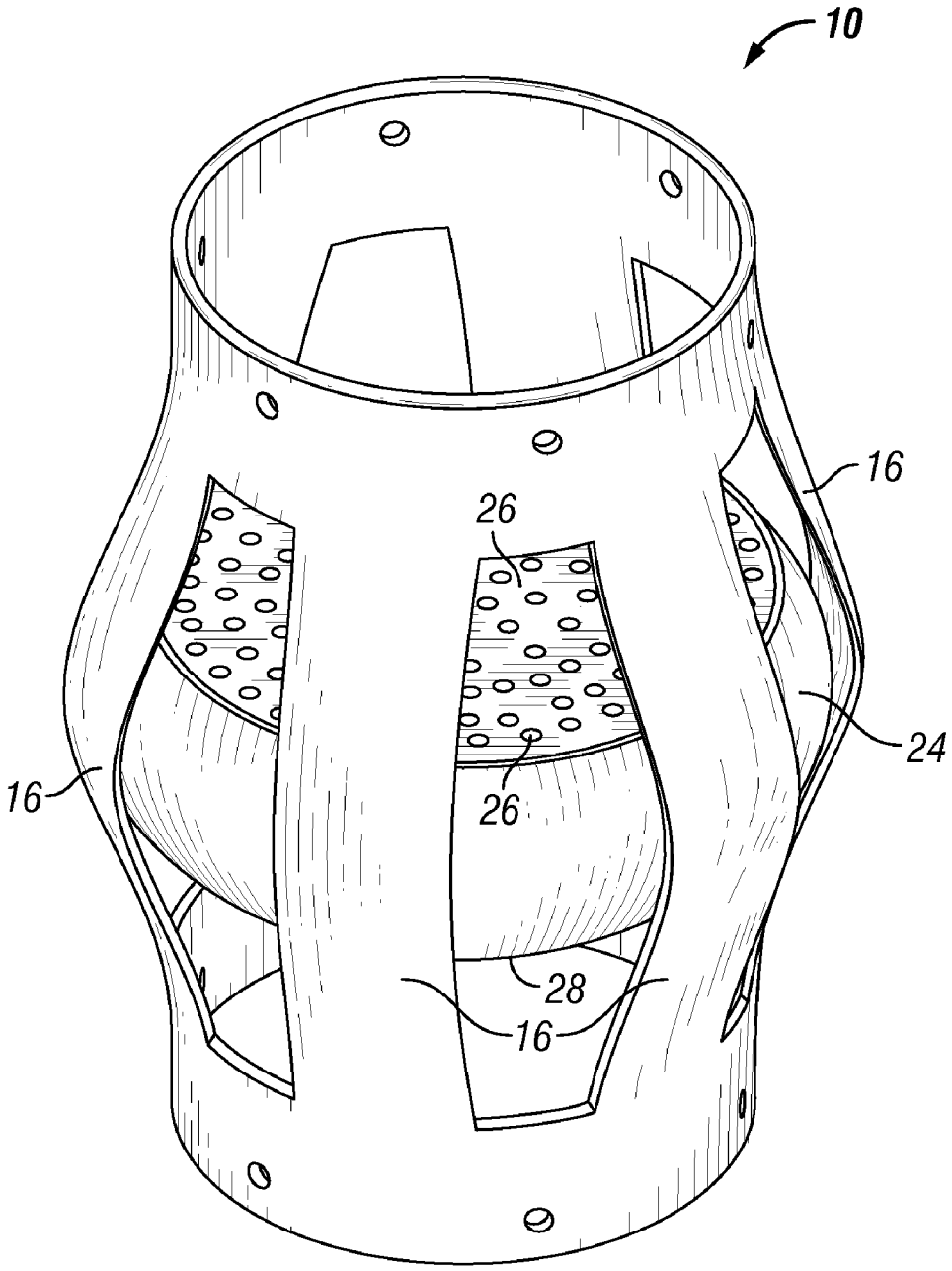
FIG. 5 is a perspective view of the centralizer in accordance with the present invention following application of force on the mandrels causing radial outward expansion of the bow spring elements (the mandrels are not shown in FIG. 5 for clarity)

FIG. 5 is a perspective view of a centralizer 10 in accordance with one example of the present invention following application of force on the mandrels causing radial outward expansion of expansion element 24 and bow spring elements 16. The mandrels are not shown in FIG. 5 for clarity.

In order to fabricate centralizer 10, a segment of steel pipe of a desired diameter is selected to be used as a blank. Using conventional fabrication equipment, a plurality of apertures 22 are formed in the blank, resulting in the intermediate form 10A of centralizer 10 shown in FIG. 4 and shown as Step 100 in FIG. 1. In the presently preferred example, apertures 22 are cut into the blank 10A by means of a laser cutting machine capable of rotating and advancing the blank in a controlled manner to achieve the desired intermediate form. Although laser cutting is the presently preferred method of forming apertures 22, those of ordinary skill will appreciate that other means of forming the apertures may be employed.

Once the blank 10A is fabricated to its intermediate state, a forming process is performed to achieve the profile of the finished product by expanding the medial portion of the bow spring elements 16, shown as Step 200. In accordance with one example, the forming process begins by insertion of an expansion element 24 into the interior of the intermediate blank 10A, shown as Step 210. An isometric view of an expansion element 24 is shown in FIG. 5. In the presently preferred example, expansion element 24 is made of a material such as Neoprene® polychloroprene, a synthetic elastomer. As shown in FIG. 5, expansion element 24 is substantially cylindrical, having upper and lower faces 26 and 28 and a cylindrical sidewall.

In the presently disclosed example, it was found desirable to drill a plurality of holes 26 (FIG. 8) longitudinally through expansion element 24 to enhance its deformation characteristics.

The next step in fabrication of centralizer 10 involves applying compressive force against the upper and lower faces 26 and 28 of expansion element 24, (shown as Step 220) this force being accomplished through placement of upper and lower mandrels 32 and 34 respectively, against the upper and lower faces 26 and 28 of expansion element 24, shown as Step 221. Each mandrel 32, 34 comprises a substantially flat cylindrical plate having the same diameter as deformable element 24.

Bow springs 16 of centralizer 10 are next formed through application of compression force to mandrels 32 and 34, as indicated by arrows 36 in FIG. 3 and shown as step 222. In the presently disclosed example, sufficient force is applied to cause deformable element 24 to expand outwardly as it is compressed axially. This is shown in FIGS. 4 and 5. As shown, the outward expansion of deformable element 24 forces bow spring element 16 to be formed.

Figure 6:
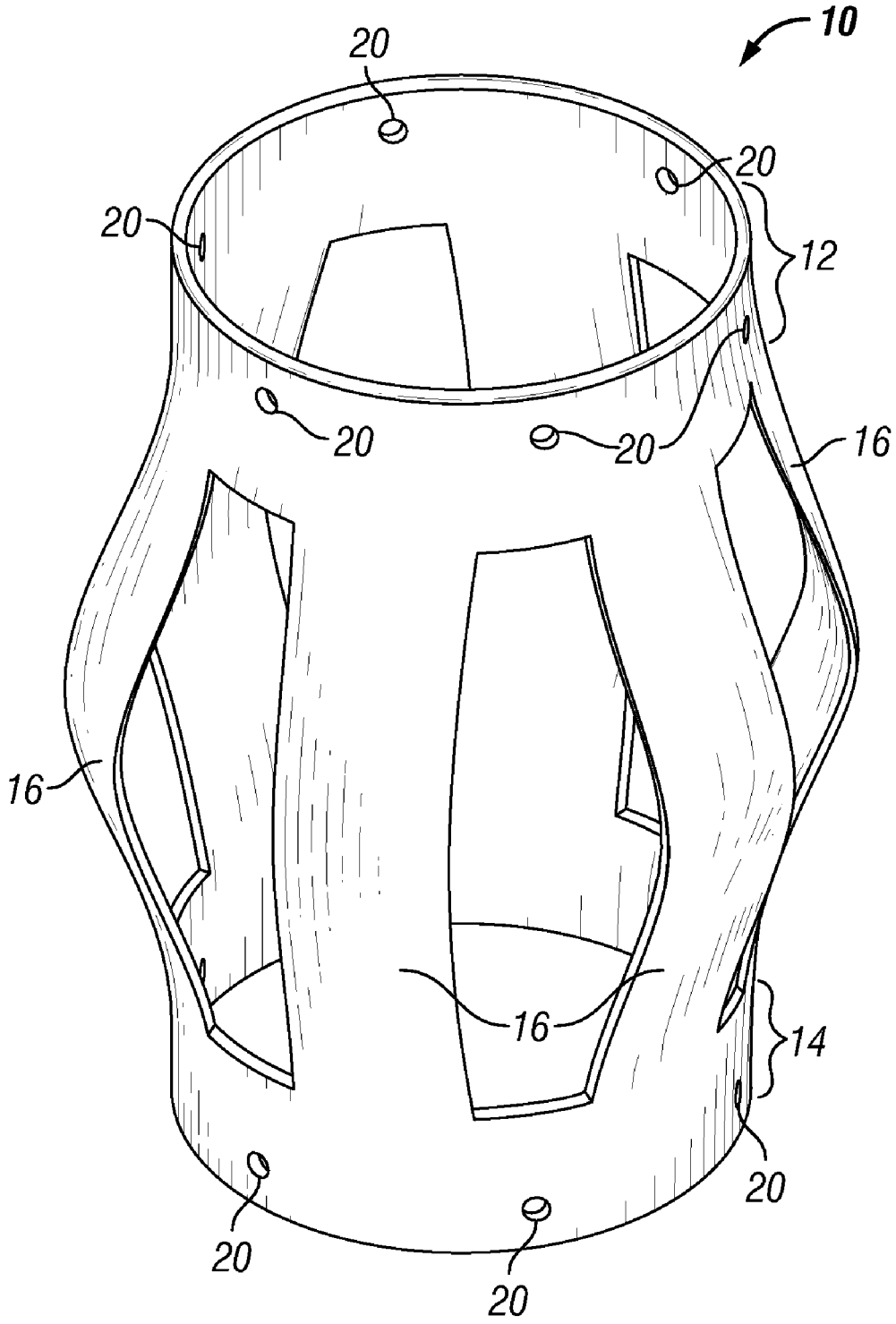
FIG. 6 is a perspective view of a bow-spring centralizer in accordance with one example of the invention following the fabrication/expansion process.

FIG. 6 is a perspective view of a bow-spring centralizer 10 in accordance with one example of the invention following the fabrication/expansion process. A plurality of bow-spring elements 16 extend radially outward between top collar 12 and bottom collar 14 portions thereof. In one example, threaded set screw holes 20 are circumferentially arranged around the top collar 12 and bottom collar 14 portions.

Figure 7:
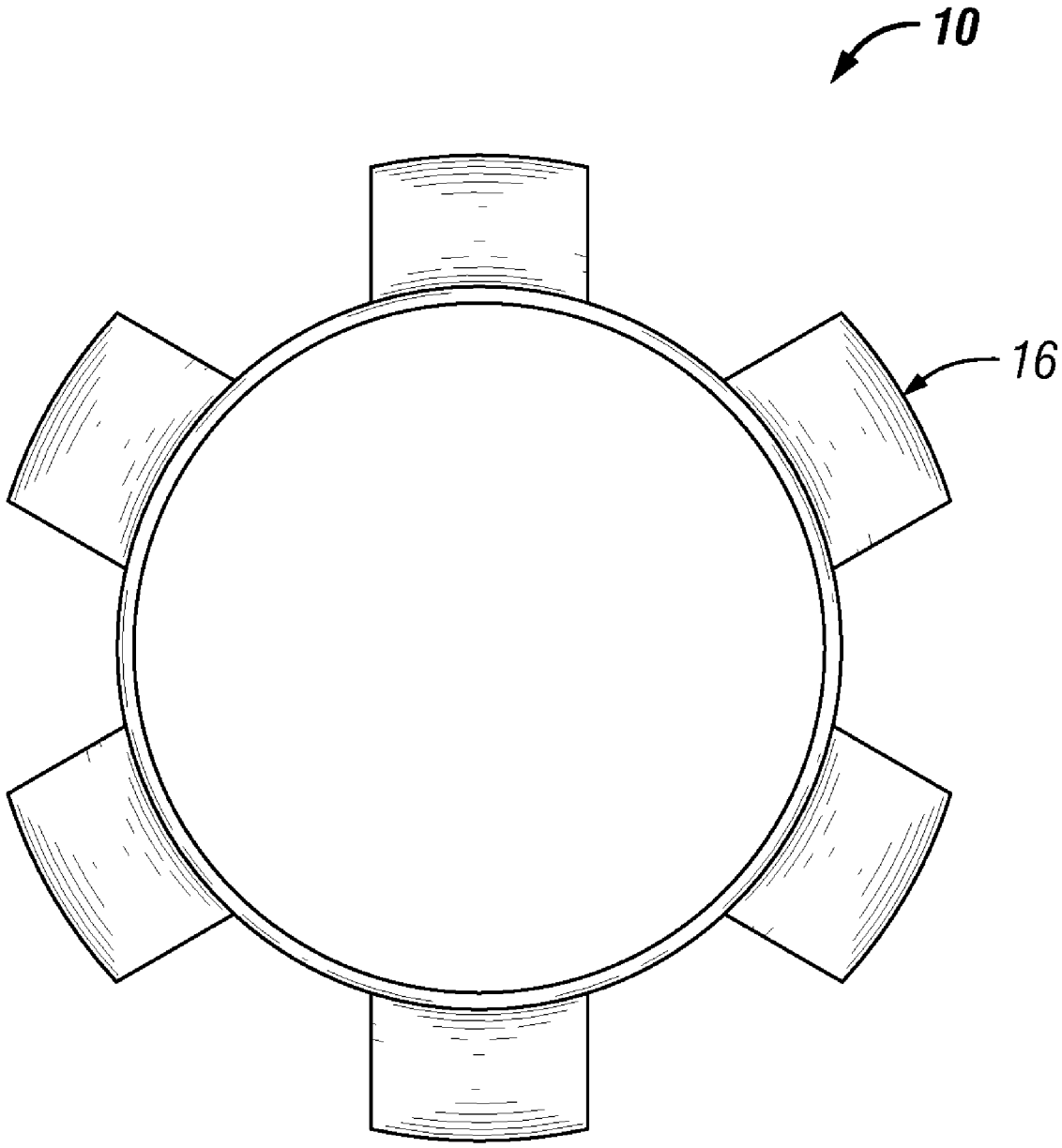
FIG. 7 is a top view of the bow-spring centralizer from FIG. 6.

FIG. 7 is a top view of the bow-spring centralizer 10 from FIG. 6. A plurality of bow-spring elements 16 extend radially outward.

Figure 8:
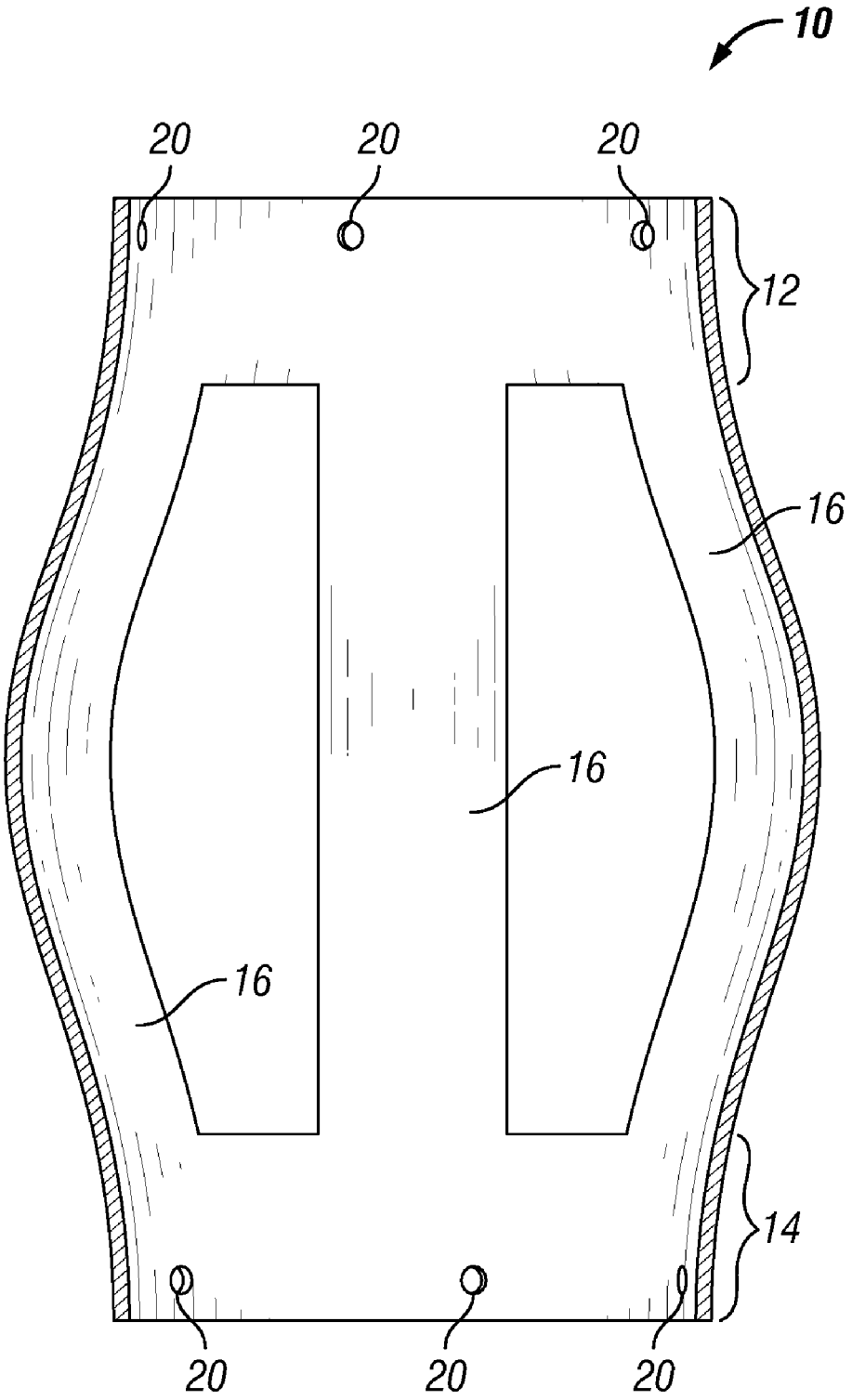
FIG. 8 is a side view of the bow-spring centralizer from FIG. 6.

FIG. 8 is a side cutaway view of the bow-spring centralizer from FIG. 6. A plurality of bow-spring elements 16 extend radially outward between top collar 12 and bottom collar 14 portions thereof. In one example, threaded set screw holes 20 are circumferentially arranged around the top collar 12 and bottom collar 14 portions.

Referring to FIGS. 5 and 7, there are shown isometric and side views, respectively of a unitary centralizer 10 in accordance with one example of the invention. As can be seen in FIG. 6, centralizer 10 comprises upper and lower collar portions 12 and 14, respectively, having a plurality of bow spring elements 16 extending between and integral with the upper and lower collars 12 and 14.

In accordance with a notable aspect of the presently disclosed example, centralizer 10 is of unitary construction, i.e., bow springs 16 extend integrally between upper and lower collar sections 12 and 14. In the preferred example, the unitary construction of centralizer 10 is achieved by forming centralizer 10 from an initially cylindrical segment of seamless steel tube. Preferably the pipe is made of a low-carbon, heat-treatable grade of steel, and in the preferred example, American Iron and Steel Institute (AISI) 4130 steel pipe is used. Those of ordinary skill will appreciate that AISI 4130 is a low-alloy steel containing molybdenum and chromium as strengthening agents, and has a low carbon content on the order of 0.30%. It is contemplated that other grades of steel pipe may also be employed for the purposes of the present invention, as would be appreciated by persons of ordinary skill having the benefit of the present disclosure.

As can be seen in FIGS. 5 and 7, in one example, centralizer 10 is provided with threaded holes 20 circumferentially arranged around the top and bottom collar portions 12 and 14. Holes 20 are adapted to receive set screws (not shown in the Figures) for securing at least one end of centralizer 10 to a tubular element.

Although specific embodiments of the invention have been described herein in some detail, it is to be understood that this has been done solely for the purposes of illustrating various features and aspects of the invention, and is not intended to be limiting with respect to the scope of the invention, as defined in the claims. It is contemplated and to be understood that various substitutions, alterations, and/or modifications, including such implementation variants and options as may have been specifically noted or suggested herein, may be made to the disclosed embodiment of the invention without departing from the spirit or scope of the invention.

What is claimed is:

1. A centralizer for maintaining a tubular member in a substantially centralized position within a borehole, comprising:

a substantially seamless material of substantially cylindrical shape, devoid of removable section, having a circumferential wall, an upper end, and a lower end;

a plurality of apertures in the circumferential wall having an upper end and a lower end, wherein the apertures define an upper collar element, a lower collar element of the circumferential wall, and bow spring elements disposed between the upper collar element and lower collar element; and wherein, each bow spring element has a medial portion of the bow spring element that is expandable radially such that the circumference of the centralizer is larger around the medial portions of the bow spring elements than the around the upper collar element and the lower collar element.

2. The centralizer of claim 1, wherein the substantially seamless material is substantially homogeneous.

3. The centralizer of claim 1, wherein the bow spring elements are elastically deformable to reduce the circumference of the centralizer around the medial portions of the bow spring elements.

4. The centralizer of claim 3, wherein the substantially seamless material is substantially homogeneous.

5. The centralizer of claim 4, further comprising a plurality of set screw holes extending radially through at least one of the upper collar element and the lower collar element.

6. The centralizer of claim 5, wherein the set screw holes are threaded.

7. A method of fabricating a centralizer for maintaining a tubular member in a substantially centralized position within a borehole, comprising:

forming a plurality of apertures in a substantially seamless material of substantially cylindrical shape, devoid of removable section, having a circumferential wall, an upper end, and a lower end to create an intermediate blank; wherein the plurality of apertures in the circumferential wall having an upper end and a lower end define an upper collar element, a lower collar element of the circumferential wall, and bow spring elements disposed between the upper collar element and lower collar element;

expanding a medial portion of the bow spring elements to cause plastic deformation of the bow spring elements; and whereby, the circumference of the centralizer is larger around the medial portions of the bow spring elements than the around the upper collar element and the lower collar element.

8. The method of claim 7, wherein the substantially seamless material is substantially homogeneous.

9. The method of claim 8, wherein the expanding further comprises:

inserting an expansion element having a substantially cylindrical shape with an upper face, a lower face, and a flexible circumferential wall into the interior of the intermediate blank;

applying a compressive force to at least one of the upper face and the lower face causing the expansion element to expand radially as it is compressed axially.

10. The method of claim 9, wherein the applying a compressive force further comprises:

placing an upper mandrel and a lower mandrel in contact with the upper face and lower face of the expansive element, respectively; and applying a compressive force to at least one of the upper face and the lower face through the upper mandrel and the lower mandrel, causing the expansion element to expand radially as it is compressed axially.

11. The method of claim 9, wherein the expansion element being inserted into the interior of the intermediate blank is made of an elastomer which expands radially as it is compressed axially.

12. The method of claim 11, wherein the expansion element comprises a plurality of holes extending through the expansion element in a longitudinal direction of the expansion element.

13. The method of claim 11, wherein the applying a compressive force further comprises:

placing an upper mandrel and a lower mandrel in contact with the upper face and lower face of the expansive element, respectively; and applying a compressive force to at least one of the upper face and the lower face through the upper mandrel and the lower mandrel, causing the expansion element to expand radially as it is compressed axially.

14. The method of claim 12, wherein the applying a compressive force further comprises:

placing an upper mandrel and a lower mandrel in contact with the upper face and lower face of the expansive element, respectively; and applying a compressive force to at least one of the upper face and the lower face through the upper mandrel and the lower mandrel, causing the expansion element to expand radially as it is compressed axially.

15. The method of one of claim 7, further comprising:

forming a plurality of set screw holes extending radially through at least one of the upper collar element and the lower collar element.

16. The method of one of claim 15, further comprising:

threading the plurality of set screw holes.

* * * * *